United States Patent [19]

Prade

[11] Patent Number: 4,556,003

[45] Date of Patent: Dec. 3, 1985

[54] SAILBOARD AND A PROCESS FOR PRODUCING THE SAME

[75] Inventor: Ernstfried Prade, Weilheim, Fed. Rep. of Germany

[73] Assignee: Mistral Windsurfing AG, Bassersdorf, Switzerland

[21] Appl. No.: 639,515

[22] Filed: Aug. 7, 1984

Related U.S. Application Data

[63] Continuation of Ser. No. 360,693, Mar. 22, 1982, abandoned.

[30] Foreign Application Priority Data

Mar. 26, 1981 [DE] Fed. Rep. of Germany ..... 3112015

[51] Int. Cl.[4] ..... B63H 9/06

[52] U.S. Cl. ..... 114/39; 441/74; 114/357

[58] Field of Search ..... 114/39.1, 39.2, 357, 114/267, 360; 441/74

[56] References Cited

U.S. PATENT DOCUMENTS

| | | | |
|---|---|---|---|
| 3,414,917 | 12/1968 | Gust | 441/74 |
| 3,514,798 | 6/1970 | Ellis | 441/74 |
| 4,129,911 | 12/1978 | McDonald et al. | 441/74 |
| 4,194,458 | 3/1980 | Messing | 114/39 |
| 4,253,209 | 3/1981 | Carn | 114/39 |
| 4,276,844 | 7/1981 | Fremont | 114/39 |
| 4,350,113 | 9/1982 | Moreau et al. | 441/74 |

FOREIGN PATENT DOCUMENTS

| | | | |
|---|---|---|---|
| 2742989 | 4/1979 | Fed. Rep. of Germany | 114/39 |
| 3003711 | 8/1981 | Fed. Rep. of Germany | 114/39 |
| 2336954 | 7/1977 | France | 441/74 |
| 2449588 | 10/1980 | France | 114/39 |

*Primary Examiner*—Trygve M. Blix
*Assistant Examiner*—Stephen P. Avila
*Attorney, Agent, or Firm*—Armstrong, Nikaido, Marmelstein & Kubovcik

[57] ABSTRACT

The present invention is with respect to craft such as surfboards and more specially sailboards made up of a board body of synthetic resin foam and with a synthetic resin shell and having fittings such as a daggerboard case, mast foot sleeves or sockets, connection points for foot straps, skegs etc. The sailboard is made up of a base element having all the fittings on it. The top part of a skin-compatible, flexible light-weight synthetic resin or plastic is fixed on the base element. All mechanical forces are taken up by the base element while the greater part of the buoyant volume is formed by the top part. The top part may more specially be so designed that it may be taken off the base element and an other one put in its place.

21 Claims, 12 Drawing Figures

Fig.1
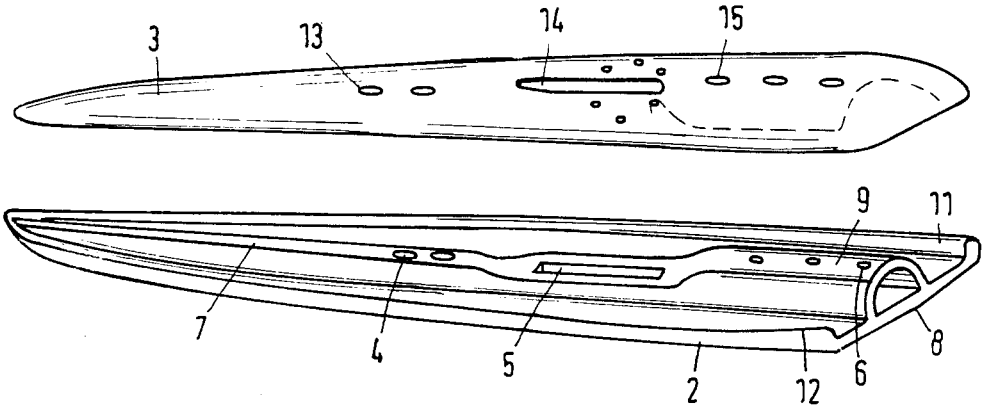
Fig.2
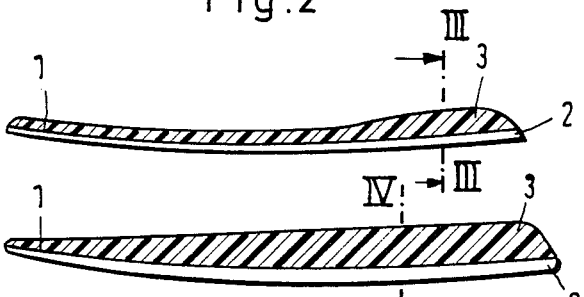
Fig.3
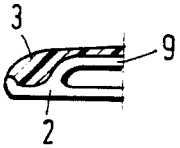
Fig.4 IV
Fig.5
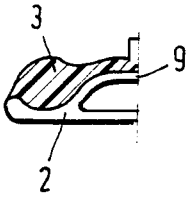
Fig.6
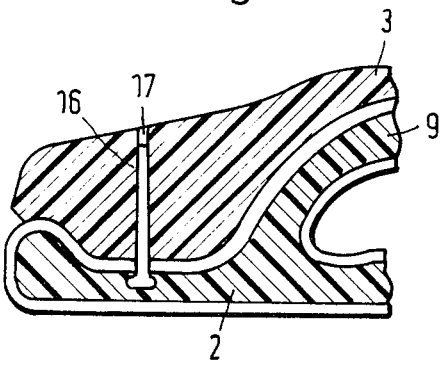

SAILBOARD AND A PROCESS FOR PRODUCING THE SAME

This application is a continuation, of application Ser. No. 360,693, filed 3/22/82 now abandoned.

BACKGROUND OF THE INVENTION

The present invention is with respect to a surfboard and more specially to a windsurfing board or sailboard with a board body of synthetic resin and synthetic resin foam and with fittings such as the daggerboard case, the mast foot sleeve, foot straps, skegs etc.

Surfboards, and more specially sailboards, on these lines are in use on a large scale, the surfboards having a foam material core or filling completely covered by an outer shell, such core being made of polyurethane, polystyrene or some other light-weight synthetic resin foam material, while the materials for the outer shell are, for example polyethylene, fiber glass reinforced resin and epoxy laminates. Furthermore, surfboards are in existence having two half shells of polyester with a filling of foam material.

Known sailboards have a number of shortcomings as, more importantly, the high weight. A further shortcoming is, for example, that it is not possible for reinforcements in the form of ribs, stringers and the like to be used in the design. Furthermore, attempts have been made at making the outer shell as thin as possible because of the high weight of the foam material to take care of weight troubles. However, the outcome is that such a board will readily be damaged by blows. A further shortcoming of present boards is that it is hard to have the fittings noted strongly fixed to the board because —as we have seen —the fittings may only be fixed to a generally feeble foam core, and best, only two outer shells which, although made of mechanically stronger material, are kept as thin as possible. Furthermore, on producing sailboards on an industrial scale, the price of the molds is of great weight. In fact, before changing the sailboard form new, high-price molds have to be produced.

GENERAL OUTLINE OF THE INVENTION

One purpose of the present invention is that of designing a surfboard and more specially a sailboard of the sort noted which takes care of the shortcomings.

For effecting this purpose, and further purposes, a surfboard or sailboard of the sort noted is so designed that it is made up of a generally stiff base element of a mechanically strong material and a top part which is joined to, or is designed for being joined to, the base element, of a flexible light-weight synthetic resin, more specially synthetic resin foam, all fittings being joined with the base element.

Quite in addition to completely effecting the general purpose of the invention, this design gives the further useful effect that on using a flexible light-weight synthetic resin which is skin-compatible, for the top part, the danger of user-injury is greatly cut down. Furthermore, simply by designing the base element, the flexibility of such a board in the length direction may be produced in the best possible way, or may even be changed simply by joining further stiffening elements to the base element or slab before joining the top part to the base element. By using the stiff, mechanically strong material having a specific gravity higher than that of synthetic resin foam, only for the lower part of the sailboard it is possible to make the craft much lighter. It would seem likely that for a sailboard, having an overall volume of about 260 liters, the weight would be between 12 and 14 kg. Because all fittings taking up mechanical forces are joined with the base element as such, it is, at the same time, possible to take care of troubles such as ripping out of the daggerboard case and of the foot straps etc. Because of the high mechanical strength of the joins, it is possible for the mast sleeve or socket to be made shorter than in the prior art, this being a very useful effect in the special field of board sailing inasfar as the transmission of forces from the mast takes place in the lower part of the sailboard. This makes the sailboard much more stable in the beam direction. Moreover, one and the same base element may readily be joined up with different top parts as desired so that different designs of surfboards or sailboards may be produced while cutting down the amount of money given out for molds.

The base element may have an upwardly running middle rib with the points for fixing on the fittings and the daggerboard case.

As a further detail of the invention, the base element ay have stringers.

At the stern it is best for the base element to have a bridge-like structure molded thereon because, as a useful effect, the main standing area of the sailboard is further stiffened. As a further development the bridge-like structure may be made hollow, may have an inflatable ballon therein or may be filled with specially light-weight foam material so that, while making certain of greatest mechanical strength there is a useful decrease in weight. Moreover, foot straps may readily be fixed to this part of the sailboard, that is to say fixed to the base element by way of the bridge-like structure and not, as in the prior art, joined to the foam filling.

Furthermore support ribs may be present within the bridge-like structure.

The base element may be more specially made by deepdrawing ABS resin, by molding polyethylene-foam-sandwich material, or made from polyurethane integral foam, from SMC (sheet molding compound) or completely or partly of wood. The selection of the material in each case will be dependent on the properties (flexibility and strength) desired of the end product.

The top part is best made of a skin-compatible material and more specially synthetic resin, that is to say plastic, foam as for example polyethylene foam or an other flexible foam material.

As part of a more specially preferred form of the invention, the top part is designed to be taken off and changed over, this making it readily possible for changes in the overall volume, the form, and more specially the form of the top face, and the foot support face, to be made. To take an example, the sailboard might be put on the market as a unit with two different top parts which, when used with the base element would give, on the one hand, an allround sailboard and on the other hand a racing board.

On the other hand, it is possible for the top part to be adhesively joined to the base element or joined thereto on producing the foam filling.

As a further preferred development of the invention, the sailboard will be generally completely covered by the top part, this cutting down the danger of injury. On the other hand, it is furthermore possible for only the front part of the sailboard to be covered by the top part while the foot area is formed by the bridge-like structure as noted.

In the case of a useful further development of the invention, the base element is made in the form of a flexible base slab with connection pieces for different forms of stringers or lengthways ribs so that different forms of sailboard may be produced with one and the same form of base slab, the slab being joined up, for example by way of a tongue and groove joint with a lengthways rib designed therefor.

The invention is furthermore with respect to a process for making a surboard and more specially as a sailboard of the sort noted, characterized in that a base element, produced from mechanically strong material having all joining structures for fixing on fittings such as the daggerboard case, the skegs, the mast foot and the like, the base element is then joined to a top part made of a synthetic resin foam or the like.

LIST OF FIGURES AND DETAILED ACCOUNT OF WORKING EXAMPLES OF THE INVENTION

Further details and further possible designs of the invention will be seen from the detailed account now to be given using the figures.

FIG. 1 is a rough perspective view of the two main parts of a sailboard of the present invention.

FIGS. 2 and 4 are views of two possible sailboard forms made, however, with the same common base element.

FIG. 3 is a section on the line III—III of FIG. 2.

FIG. 5 is a section on the line V—V of FIG. 4.

FIG. 6 is a rough section to make clear one way of joining the top part to the base element.

Figure 7:
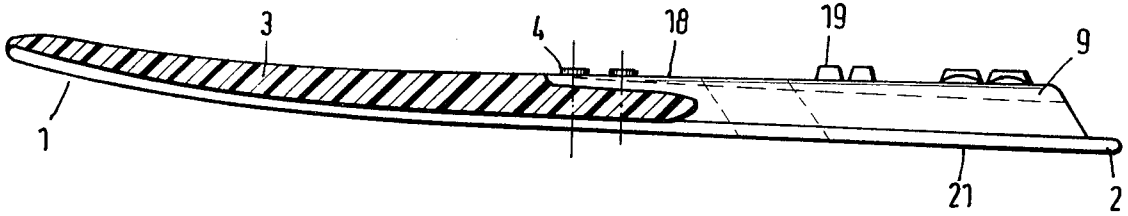
FIG. 7 is a side view of a further possible form of the invention.
Figure 8:
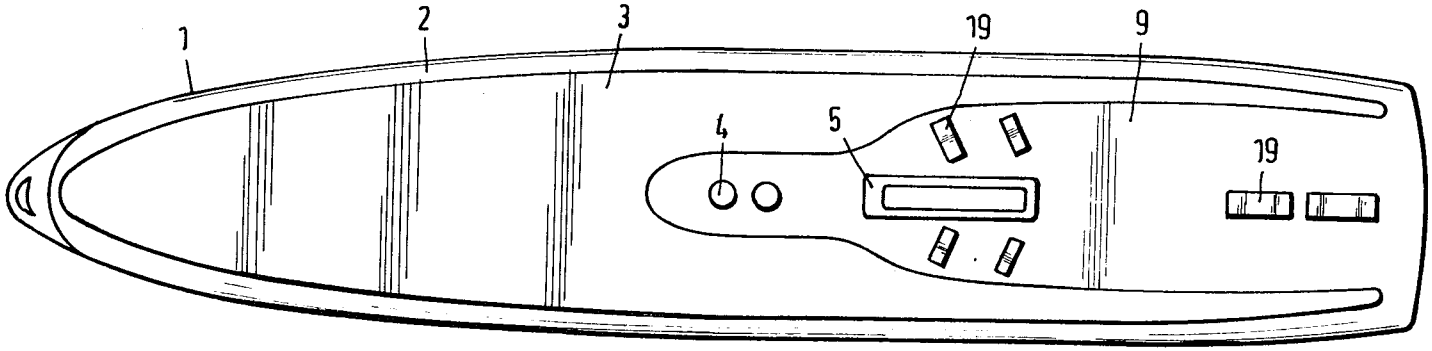
FIG. 8 is a plan view of the sailboard of FIG. 7.
Figure 9:
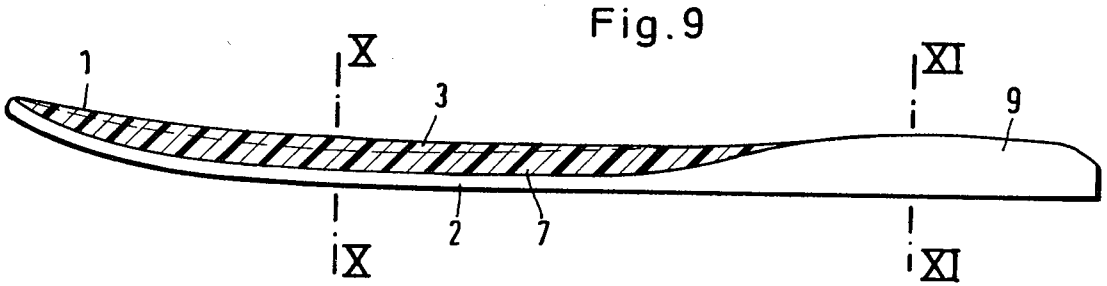
FIG. 9 is a view of a further working example of the invention as seen diagrammatically from the side.
Figure 11:
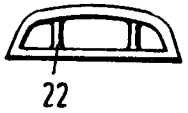
FIG. 10 and FIG. 11 are sections on the lines X—X and XI—XI of FIG. 9.
Figure 10:
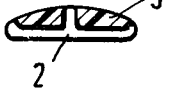
Figure 12:
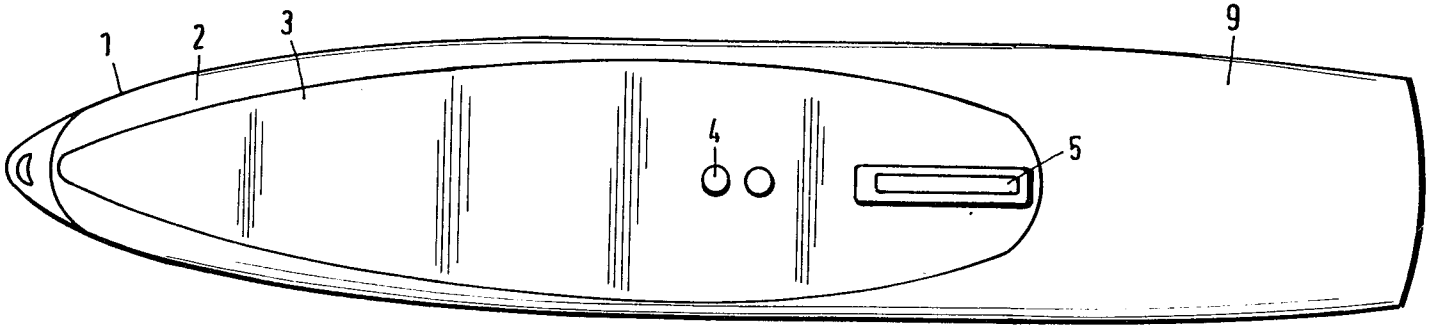
FIG. 12 is a plan view of the working example of the invention to be seen in FIG. 9 on a somewhat larger scale.

As will readily be seen from the perspective view of FIG. 1, a sailboard or windsurfing board of the present invention, generally numbered 1, is made up of two main parts, that is to say a base element or lower hull 2 and a top part 3. The base element 2 is produced from a mechanically strong material by some forming or molding process of the right sort. Materials which may be used are for example ABS resin, polyethylene-foam-sandwich material, polyurethane integral foam, SMC (sheet molding compound) material or furthermore wood or wood used with one of the said synthetic resins (plastics).

As may be seen the base element 2 of the mechanically strong material has all the fittings normally used, or connection points for such fittings of sailboards, that is to say for example the mast sleeves 4, the daggerboard case 5 and fixing points 6 for foot straps.

In the preferred working example the base element 2 has at least one middle rib 7 or backbone with a form designed to give the desired degree of flexibility of the sailboard 1. To the same end the base element 2 may have further stringers (not figured), not only the backbone 7, but furthermore the stringers not necessarily being made in one piece with the base element 2. To take an example, the base element 2 may have dovetail grooves or like locking openings or cutouts in which male parts of the stringers or of the backbone 7 may be pushed in and locked in place. With this design it is possible, simply by changing the form of the backbone or of the stringers, for sailboards with a completely different form, more specially with respect to the keel shoulder, to be produced.

For reinforcement of the main foot area (for making it stiffer) of the sailboard 1, the base element 2 has at the stern 8 a bridge-like structure 9 which, as well, as made in one piece with the base element 2 or is joined up with it by connections. Further details of the bridge-like part 8 will be given later on.

For producing a good hydrodynamic form, the base element 2 has upwardly lipped side edges 11, 12 which may have the sharp corners as joins with or limits of the lower hull and may furthermore have front keel-like structures forming part of the underwater hull of the sailboard 1.

The top part 3, to be seen for example in FIG. 1, is best made of an elastic skin-compatible material with a low density as for example polyethylene foam or other sorts of foam, rubber (such as neoprene) or other flexible materials. On the other hand, the top part 3 may furthermore be made of a rubber or synthetic resin inflatable balloon or mattress. On producing the sailboard 1, the top part 3 may be directly joined with the base element 2 by molding the foam, that is to say making the top part in situ, or the top part 3 may be made as a separate part of the sailboard and then later joined to the base element 2 as produced. Different possible ways of joining the top part 3 to the base element 2 will be detailed later on.

In any case the design is such that the top part 3 is not acted on by any mechanical forces, or at least forces in connection with fittings 4, 5 and 6, so that the selection design of the top part 3 may be made to make it as skin-compatible as possible and furthermore to get the lowest weight or density. The top part 3 will be seen from FIG. 1 to have openings or cutouts 13, 14 and 15 matching fittings 4, 5 and 6. Furthermore, it is clear that the top part 3 will be matched in its form to the area of the base part 2 on which it is to fixed.

In FIGS. 2 to 5 it is possible to see details in connection with the part of the invention in connection with the use of one and the same base element 2 with different forms of the top part 3 so that sailboards of completely different forms and properties are produced.

In FIGS. 2 and 3 a heavy wind sailboard with a low volume will be seen, while the sailboard 1 of FIGS. 4 and 5 is very much greater because of the design of the top part 3 in this respect: In this connection see the further details given in the account of FIG. 1.

The possible design points to be seen in FIGS. 2 and 4 may be so used in connection with a top part 3 (which may be undone and taken off the base element 2) that for example two different top parts 3 may be used with one and the same base element 2 and so that the boardsailor will be able to make changes in his sailboard for different purposes.

Because of the properties of the material of the top part such a connection with the base element may be in the form of a sort of button, that is to say using male parts 16 on the base element 2 for slipping into matching openings 17 in top part 3.

In FIGS. 7 to 12 two further working examples of the invention will be seen in which only part of the deck area 18 of the sailboard 1 is formed by, or covered by, the top part 3. As is the case with the other forms of the invention, all fittings 13 to 15 are parts of the base element 2, while the main volume of the sailboard 1 is formed by the top part 3. In the working examples of FIGS. 7 to 9, however, the foot area for the boardsailor to the aft of the mast foot sleeves 4 is formed by the bridge-like structure 9 which, as a tailpiece to the backbone 7 or middle rib further-more has the daggerboard case 5 in it and the foot straps 19 (see FIG. 7) on it.

The bridge-like structure 9 may, as will be seen from FIG. 7, be filled with a light-weight synthetic resin foam 20, or, in a further possible design, an inflating balloon (not figured) may be housed in the space between the lower hull 21 and the bridge-like structure 9 of the base element 2. Furthermore, this space may be kept unfilled or, if desired, to be used for housing support ribs 22, see FIG. 11.

It will be clear that with the design of the present invention and the process for producing craft of the invention, sailboards with very high-class properties may be produced, more specially with respect to the very low weight possible, using a simple process. Using the design, which, generally speaking, is a two-part one, the most different forms of sailboard may be produced. Furthermore, by using a generally flexible, soft foam material for the top part 3, the danger of injury is greatly reduced.

Because, before putting on the top part 3, it is possible to get at all parts of the base element 2, changes may be made in the flexibility of the completed sailboard in the lengthways direction by using stiffening elements of the right sort and fixing them in place. It is then readily possible for aluminum parts or the like, for example, to be fixed in place. Because all mechanical forces in connection with the fittings are taken up by the mechanically strong base group of parts of the sailboard, the selection of the synthetic resin or plastic foam forming the buoyancy volume of the sailboard 1 may take place without its mechanical strength being important.

All details and useful effects of the invention to be seen in the specification, the claims and the figures, and all details of design and configuration may be important for the invention separately or in any way in which they may be used together.

I claim:

1. In a sailboard having a board body of synthetic resin and synthetic resin foam and fittings joined to the board body, said board body comprising:

a one piece lower part having a hard outer face and being in the form of a generally stiff base element of a material with a high mechanical strength, the fittings being joined to the base element such that all mechanical forces thereof are taken up by the base element; and a top part engageable with said lower part and being composed of a flexible, light-weight synthetic resin material such that said top part presents an upper exposed surface of said flexible, light-weight resin material said top part having most of the buoyancy of the sailboard compared with the lower part said lower part being generally less buoyant.

2. A sailboard as claimed in claim 1, wherein the base element has an upwardly running middle backbone integral therewith, the fittings being mounted on said backbone.

3. A sailboard as claimed in claim 1 having at least one stringer on said base element.

4. A sailboard as claimed in claim 1 having, as part of the base element at the stern of the sailboard, a bridge-like structure.

5. A sailboard as claimed in claim 4, wherein said bridge-like structure is hollow.

6. A sailboard as claimed in claim 5 having an inflatable balloon within said bridge-like part.

7. A sailboard as claimed in claim 5, wherein said bridge-like structure is filled with foam material.

8. A sailboard as claimed in claim 5, having support ribs in a space bridged over by said bridge-like structure.

9. A sailboard as claimed in claim 1 wherein said base element is made of deep-drawn ABS sheet material.

10. A sailboard as claimed in claim 1 wherein said base element is made of a polyethylene-foam-sandwich material.

11. A sailboard as claimed in claim 1, wherein said base element is made of polyurethane integral foam.

12. A sailboard as claimed in claim 1 wherein said base element is made up of SMC.

13. A sailboard as claimed in claim 1 wherein said base element is made up at least in part of wood.

14. A sailboard as claimed in claim 1 wherein said top part is made of a skin-compatible material.

15. A sailboard as claimed in claim 1, wherein said top part is so joined to said base element that said top part may be taken off and its place taken by an other such top part.

16. A sailboard as claimed in claim 1 wherein generally the complete top of the sailboard is covered by said top part over the waterline.

17. A sailboard as claimed in claim 4 wherein a forward part of said sailboard is covered by said top part whereas an aft area, generally forming the foot area for the board-sailor, is formed by said bridge-like structure.

18. A sailboard as claimed in claim 1 wherein said base element is in the form of a flexible base slab having connection structures for joining reinforcing structures of different forms to the base slab.

19. A sailboard as claimed in claim 18 in which said reinforcement structures are stringers.

20. A sailboard as claimed in claim 18 in which said reinforcement structures are ribs stretching in the forward-aft direction of said sailboard.

21. A process for producing a sailboard having a board body of synthetic resin and synthetic resin foam and fittings joined to the board body, comprising joining a one piece lower part, having a hard outer face and being in the form of a generally stiff base element of a material with high mechanical strength, the fittings being joined to the base element such that all mechanical forces thereof are taken up by the base element, to a top part engageable with said lower part and being composed of a flexible, light-weight synthetic resin material such that the top part presents an upper exposed surface of said flexible, light-weight resin material, said top part having most of the buoyancy of the sailboard compared with the lower part, said lower part being generally less buoyant.

* * * * *

UNITED STATES PATENT AND TRADEMARK OFFICE

CERTIFICATE OF CORRECTION

PATENT NO. : 4,556,003

DATED : December 3, 1985

INVENTOR(S) : ERNSTFRIED PRADE

It is certified that error appears in the above-identified patent and that said Letters Patent is hereby corrected as shown below:

Column 2, line 23, change "ay" to --- may ---.

Signed and Sealed this

*Eighth* Day of *July 1986*

[SEAL]

*Attest:*

DONALD J. QUIGG

*Attesting Officer*

*Commissioner of Patents and Trademarks*